United States Patent [19]

Pagano

[11] Patent Number: 4,693,697

[45] Date of Patent: Sep. 15, 1987

[54] PUSH-PULL TOY

[75] Inventor: Robert J. Pagano, Mineola, N.Y.

[73] Assignee: Wonderline, Inc., Bossier City, La.

[21] Appl. No.: 804,416

[22] Filed: Dec. 4, 1985

[51] Int. Cl.[4] ..... A63H 5/00; A63H 11/10

[52] U.S. Cl. ..... 446/272; 446/292; 446/411

[58] Field of Search ..... 446/272, 292, 409, 411, 446/298, 297, 280, 281, 282, 284, 450, 269, 289, 290, 291, 294

[56] References Cited

U.S. PATENT DOCUMENTS

| | | | |
|---|---|---|---|
| 669,177 | 5/1901 | O'Neill | 446/280 |
| 1,354,381 | 8/1920 | Dayon | 446/284 |
| 1,416,029 | 5/1922 | House . | |
| 2,410,646 | 11/1946 | Finn et al. | 446/272 |
| 2,506,719 | 5/1950 | Gregg | 312/47 |
| 2,578,579 | 12/1951 | Mysels . | |
| 2,617,231 | 11/1952 | Doe et al. | 446/272 |
| 2,747,328 | 5/1956 | Zalkind . | |
| 2,800,745 | 7/1957 | Zalkind . | |
| 2,833,083 | 5/1958 | Dunstan . | |
| 2,835,074 | 5/1958 | Crawford et al. . | |
| 2,879,625 | 3/1959 | Bolger . | |
| 2,937,475 | 5/1960 | Crawford . | |
| 3,238,665 | 3/1966 | Doe . | |
| 4,225,138 | 9/1980 | Wolf . | |
| 4,248,009 | 2/1981 | Ferris et al. | 446/409 |

FOREIGN PATENT DOCUMENTS

| | | | |
|---|---|---|---|
| 971362 | 7/1975 | Canada | 446/272 |
| 1476013 | 6/1977 | United Kingdom | 446/272 |

*Primary Examiner*—Mickey Yu

*Attorney, Agent, or Firm*—Roy A. Ekstrand

[57] ABSTRACT

A push or pull toy (walker toy) comprises a hollow body simulating the body of an animal and formed with a transparent or semitransparent window, wheels for supporting the body and enabling transport thereof over a supporting surface in response to an applied force, and a dual ancillary movement generator having a first branch adapted to effect a nodding of a simulated animal head connected to the body and a second branch adapted to effect the pop-ejection of marbles or balls that are contained within the body and visible through the window.

14 Claims, 12 Drawing Figures

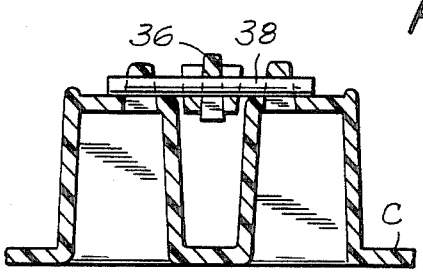
FIG. 7
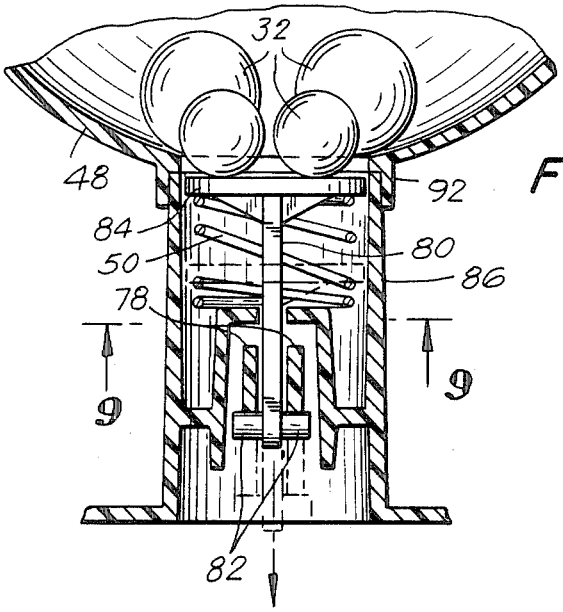
FIG. 8
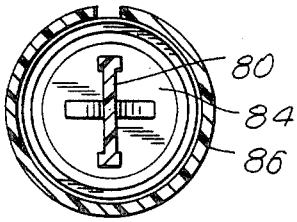
FIG. 9
FIG. 10
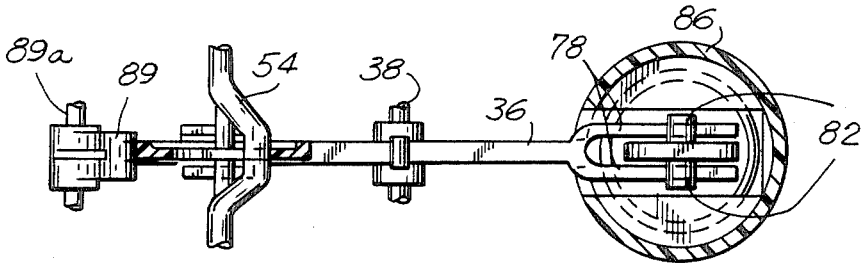

PUSH-PULL TOY

BACKGROUND OF THE INVENTION

1. Field of the Invention

This invention relates to toys and, more particularly, to a novel, safe and durable push or pull toy that effects ancillary movements having a special appeal to toddlers and other young children.

2. Description of the Prior Art

Toddlers and other young children enjoy toys that can be pushed or pulled (push-pull toys). However, the attention span of young children is short, and a push-pull toy having no ancillary features will not sustain a child's interest for very long.

It is conventional to incorporate ancillary features in push-pull toys, but the results have not been wholly satisfactory. In the prior art, there is typically only one ancillary feature or a plurality of ancillary features all of substantially the same character, and typically there is only one way to operate the toy and its ancillary features. As a result, the toy quickly loses its appeal.

Moreover, the provision of ancillary features in general reduces the durability of a toy. This is a major consideration, since toddlers and other young children have acquired sufficient size, strength and coordination to inflict considerable abuse on playthings and have not acquired the judgement to understand the consequences of such abuse or to exercise restraint.

The provision of ancillary features therefore often results in various parts becoming separated from the toy proper. Such parts can be dangerous to young children, since a small part may be swallowed or become lodged in the trachea, or a portion of the toy intended to be ensheathed within the toy when the toy is properly assembled may be sharp and pose a danger of cutting the eye or skin.

OBJECTS AND SUMMARY OF THE INVENTION

An object of the invention is to remedy the problems of conventional push-pull toys outlined above and, in particular, to provide a push-pull toy that effects ancillary movements having a special appeal to toddlers and other young children and that is safe for use by young children and rugged enough to withstand considerable abuse without danger of falling apart.

Another object of the invention is to provide a toy having ancillary features the respective characters of which are substantially different, thereby lending added appeal to the toy.

Another object of the invention is to provide a toy that has a plurality of ancillary features and can be operated in more than one way.

These and other objects are attained, according to one aspect of the invention, by the provision of a push or pull toy comprising: a body portion, support and transport means for supporting the body portion and enabling transport thereof over a supporting surface in response to an applied force, and dual ancillary movement means having a first branch adapted to effect a first ancillary movement of a first character and a second branch adapted to effect a second ancillary of a second and substantially different character; the first and second ancillary movements being selected to appeal to a young child and the ancillary movement means effecting both of the ancillary movements in response to actuation by the support and transport means.

BRIEF DESCRIPTION OF THE DRAWINGS

A better understanding of the objects, features and advantages of the invention can be gained from a consideration of the following detailed description of the preferred embodiment thereof in conjunction with the appended figures of the drawing, wherein like reference characters designate the same elements and parts, and wherein:

FIGS. 4, 5, 6, 7 and 8 are fragmentary transverse sectional views taken respectively substantially along the lines 4—4, 5—5, 6—6, 7—7 and 8—8 of FIG. 2 and looking in the direction of the arrows;

FIG. 9 is a fragmentary sectional view taken substantially along the line 9—9 of FIG. 8 and looking in the direction of the arrows;

FIG. 10 is a fragmentary sectional view taken substantially along the line 10—10 of FIG. 3 and looking in the direction of the arrows;

DESCRIPTION OF THE PREFERRED EMBODIMENT

Figure 1:
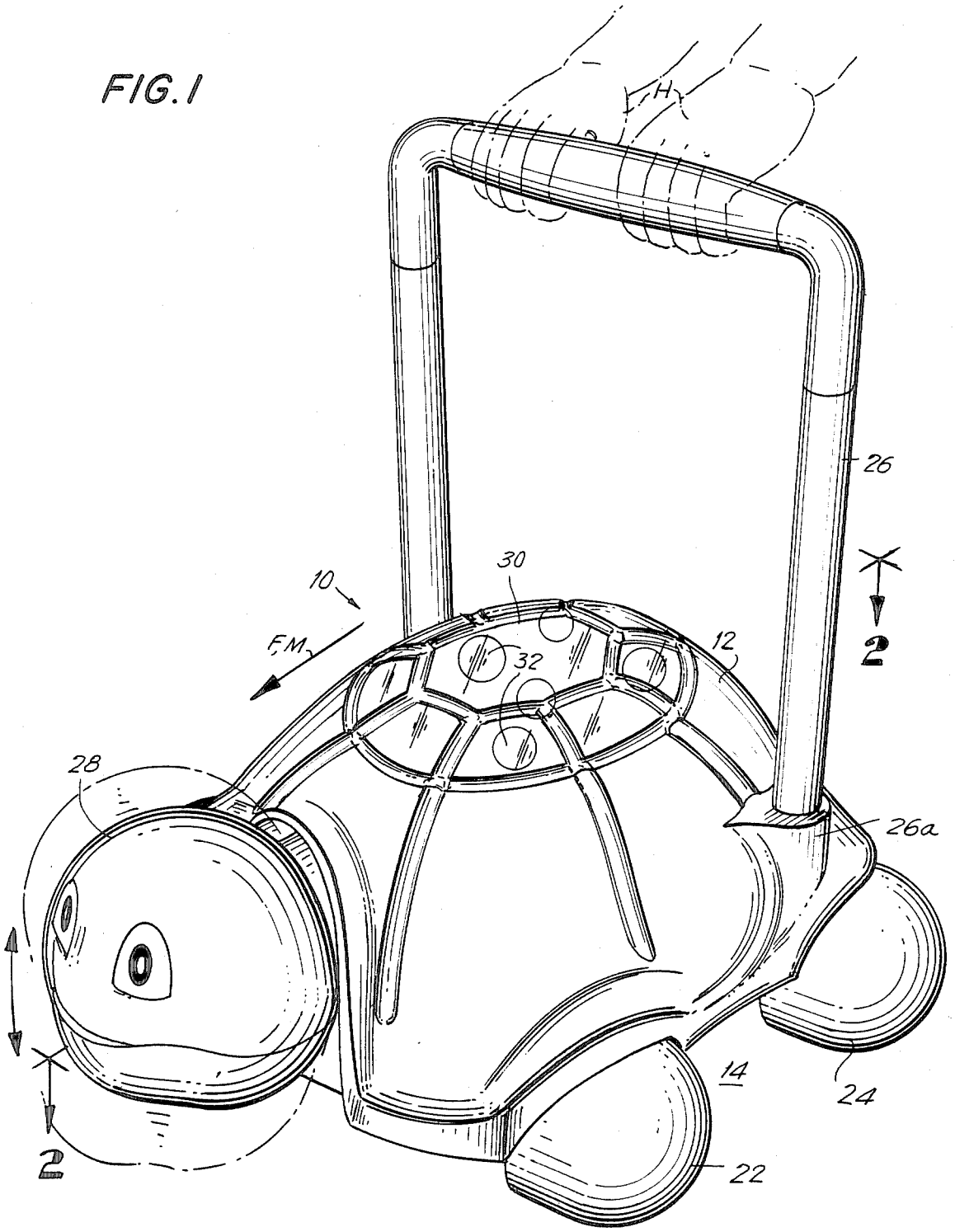
FIG. 1 is a perspective view of a preferred embodiment of a push or pull toy constructed in accordance with the invention.

FIG. 1 shows a push or pull toy or walker 10 constructed in accordance with the invention. The toy 10 comprises a body portion 12 and transport and support means 14 for supporting the body 12 and enabling transport thereof over a supporting surface S (FIG. 3) in response to an applied force. The body 12 is formed with a number of hollow studs or posts exemplified by the studs 12*a* (FIG. 4) that fit within respective hollow receptacles 12*b*. The studs 12*a* are tapered from top to bottom and fit snugly within the respective receptacles 12*b*, the interiors of which are formed with a corresponding taper. Fastening means such as screws 12*d* are inserted through openings 12*c* in the respective bottoms of the receptacles 12*b* and into the hollow interiors of the studs 12*a*, thereby securing the body 12 to the chassis C.

The force F causing transport or movement of the toy 10 may be applied by the hands H of a toddler acting on a handle 26, as indicated in FIG. 1. The force F causes movement M (which may be represented by the same vector). The force and movement vectors F, M are normally in a direction away from the toddler if the toy 10 is constructed (as shown) as a push toy. However, the construction of the toy 10 is such, as described below, that the toy 10 functions also in reverse; i.e., if the toddler pulls rather than pushes on the handle 26, the toy 10 moves in reverse and the first and second ancillary movements described below are performed just as in the case of forward or normal movement, so long as the drive wheels 22 remain adequately in contact with the supporting surface S. Moreover, the toy 10 can be constructed as a pull toy by providing a string or other pulling device to the front of the toy. It is also within the scope of the invention to operate the toy 10 by applying the hands directly to the body 12.

Dual ancillary movement means or an ancillary movement generator 16 (see especially FIGS. 2, 3 and 11) is provided having a first branch 18 (best shown in FIGS. 3 and 11) adapted to effect a first ancillary movement of a first character and a second branch 20 adapted to effect a second ancillary movement of a second and substantially different character. Both the first and the second ancillary movements are selected to appeal to a young child. The ancillary movement generator 16 effects both of the ancillary movements in response to actuation by the support and transport mechanism 14, as described below.

The body 12 preferably simulates the body of an animal, for example a turtle. The support and transport mechanism 14 comprises left and right front wheels 22 and left and right rear wheels 24. The number of wheels is thus four, each simulating a different leg of the turtle or other animal.

In the preferred embodiment (illustrated), the front wheels 22 serve as drive wheels. However, it is also possible for the rear wheels to serve as drive wheels or to employ a special fifth drive wheel or other suitable drive mechanism. As indicated above, the handle 26 is attached to the body 12 for application of a force (push or pull) whereby the toy is propelled across the supporting surface S. The dimensions of the toy 10 including the handle 26 are such that a toddler in a standing position can comfortably grasp the handle, as indicated schematically by the pair of hands H. The handle 26 is received within receptacles 26*a* formed in the body 12.

The first branch 18 of the ancillary movement generator 16 comprises a simulated head 28 of the turtle or other animal, and the first ancillary movement includes a movement of the head 28 with respect to the body 12. Such movement preferably includes a nodding of the head.

The body 12 includes a transparent or semitransparent window portion 30, and the toy 10 further comprises a plurality of independently movable objects 32 contained within the body 12 and visible through the window 30. The second ancillary movement includes movement of the objects 32 as described below.

The objects 32 preferably include balls or marbles and may be of different sizes and/or colors. The second ancillary movement preferably includes an accumulation (Fig. 11) and pop-ejection of the balls or other objects 32 within the body 12.

In order to effect the first and second ancillary movements, the toy 10 comprises cam means 34 (see especially FIGS. 3, 6, 11 and 12) engageable with and actuated by the support and transport mechanism 14. Lever means 36 is engageable with and actuated by the cam 34, and a pivot shaft mounting means 38 mounts the lever 36 for pivoting movement. The first branch 18 of the ancillary movement generator 16 includes a first portion 40 of the lever 36, and the second branch 20 of the ancillary movement generator 16 includes a second portion 42 of the lever 36.

Mounting means 44 is provided for mounting the head for pivoting movement between a normal position (FIG. 3) and a nodding position (FIG. 11) The mount 44 includes a horizontal transverse shaft 44*a* supported in trunnions 44*b*. The trunnions are mounted on the chassis C and are disposed to the left and right sides of the longitudinal conterline 3—3 (FIG. 2) of the toy 10.

Figure 3:
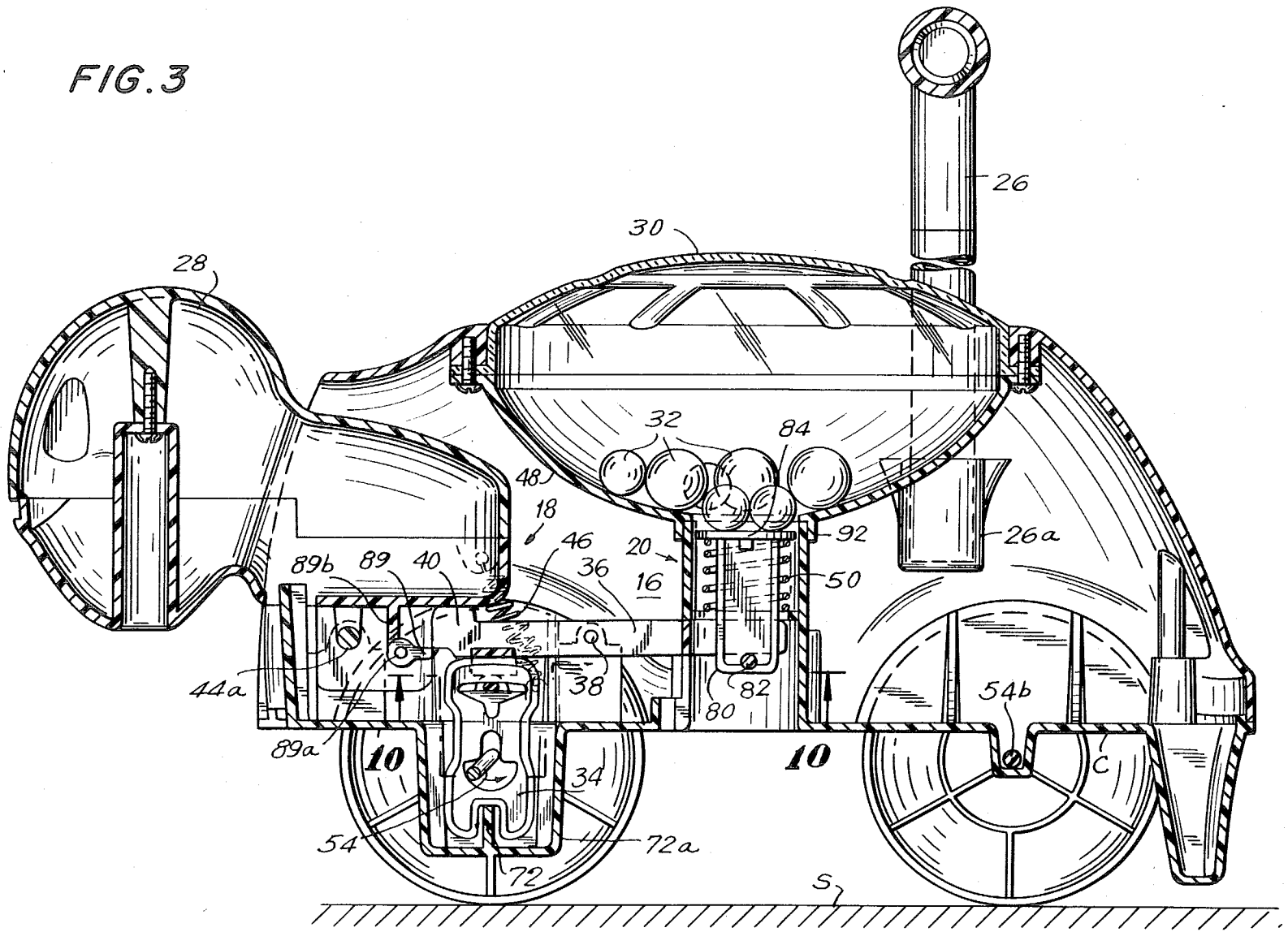
FIG. 3 is a longitudinal sectional view taken substantially along the line 3—3 of FIG. 2 and looking the direction of the arrows.
Figure 4:
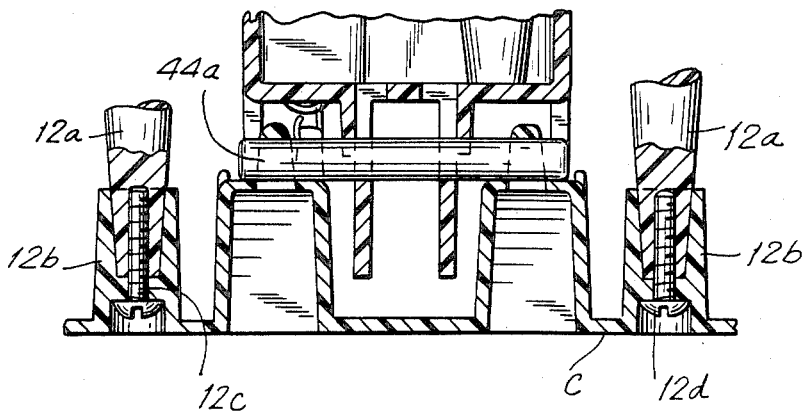
Figure 5:
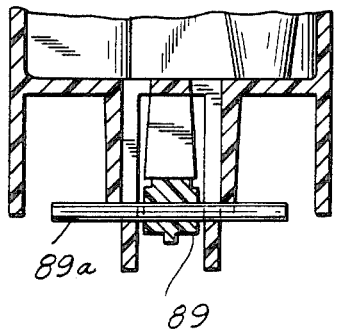
Figure 6:
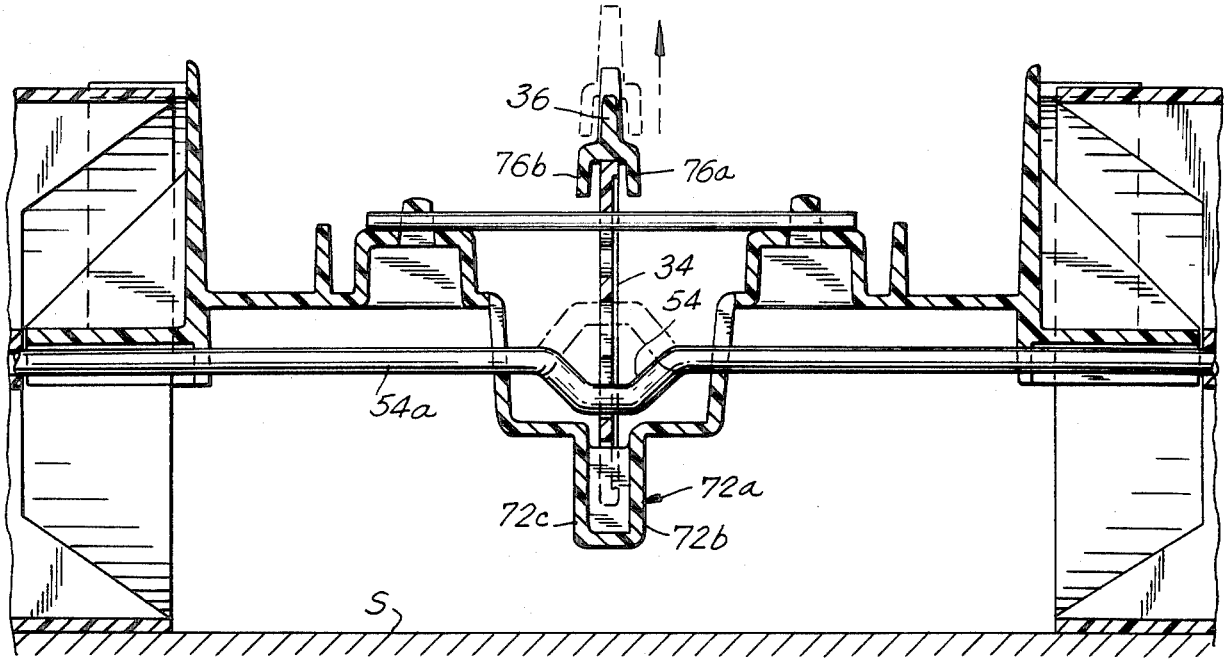

Biasing means such as a tension coil spring 46 biases the head 28 to one of the normal and nodding positions and preferably to the normal position illustrated in FIG. 3. The first portion 40 (FIG. 11) of the lever 36 causes periodic movement of the head 28 to the other of the normal and nodding positions (preferably to the nodding position of FIG. 11) in response to the pivoting of the lever 36 by the cam 34 as the toy 10 advances over the supporting surface S. The cam 34 periodically releases the lever 36, as described below, and the spring 46 then restores the head to its original position (the normal position of FIG. 3).

The second branch 20 of the ancillary movement generator 16 includes a funnel-shaped container 48 mounted within the body 12 beneath the window 30. Second biasing means such as a compression coil spring 50 is mounted in the bottom of the funnel-shaped container 48. The second portion 42 of the lever 36 causes periodic loading (FIG. 11) of the spring 50 in response to pivoting of the lever 36 by the cam 34. When the cam 34 periodically releases the lever 36, the spring 50 then causes the pop-ejection of the balls or marbles 32 within the body 12.

The cam 34 comprises a three-section active portion 52, and the support and transport mechanism 14 comprises a circular motion drive 54 (FIGS. 2, 3, 6, 10, 11 and 12) responsive to the force applied to the handle 26 (FIG. 1). The circular motion drive 54, shown in different positions in the several figures, is engageable in one of the three sections 56, 58, 60 for effecting limited pivoting and translational movements of the cam 34 and pivoting movement of the lever 36 and is movable into another of such sections for enabling a return movement of the cam 34 and lever 36.

Figure 11:
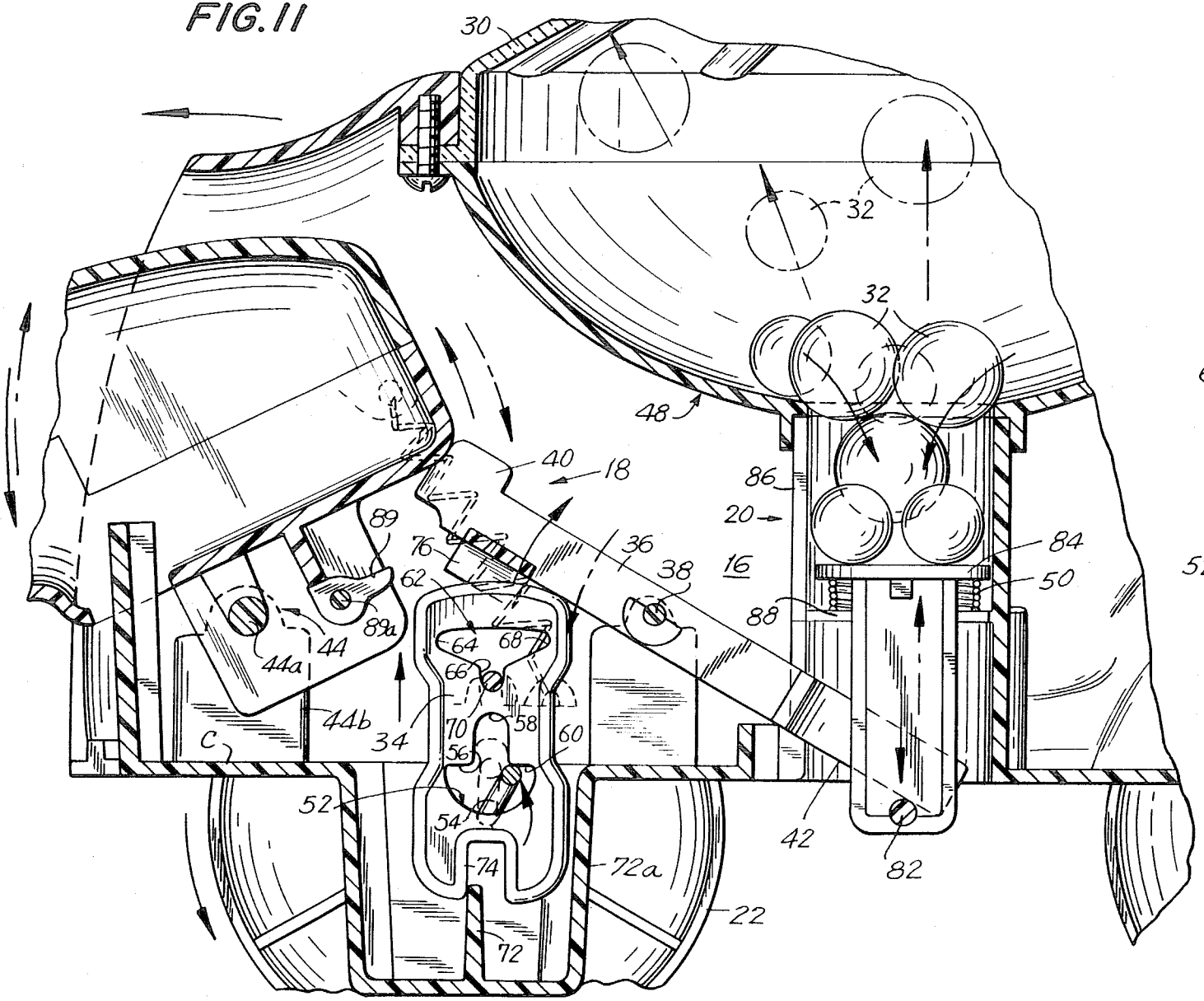
FIG. 11 is a fragmentary view similar to FIG. 3 but on a larger scale and showing a portion of the toy in a different operating position thereof.

The circular motion drive 54 turns counterclockwise (from the perspective of FIGS. 3, 11 and 12) for forward movement of the toy 10 and clockwise for reverse movement of the toy 10. The circular motion drive 54 is formed by a generally U-shaped bend in an axle 54*a* (FIG. 2) which is connected to the front wheels 22. The axle 54*a* turns with the front wheels 22, thereby causing the base of the U-shaped bend in the axle 54*a* to move orbitally along a circular path. As FIG. 11 shows, when the circular motion drive 54 is rotated counterclockwise approximately to the 1 o'clock position, it is engaged in the section 60, thereby elevating the cam 34. When the circular motion drive 54 reaches approximately the 12 o'clock position (not illustrated), it becomes suddenly disengaged from the section 60 and becomes engaged in the section 58, permitting the cam 34 to drop and thereby permitting the lever 36 to be returned to the normal or horizontal position of FIG. 3 by virtue of the action of the compression spring 50, as explained below. In its sudden expansion, the spring 50 causes a popping noise appealing to a young child and a pop-ejection of the balls or marbles 32 within the hollow interior of the body 12.

The cam 34 further comprises a three-section guide 62 complemental to the active portion 52 of the cam 34. The guide 62 includes three sections 64, 66, 68. Restraining means such as a bar or rod 70 cooperates with the guide 62 and is engageable with any of the three sections 64, 66, 68 thereof for permitting limited translation and rotation of the cam 34. A flange 72 cooperates with a slot 74 in the bottom of the cam 34 for limiting the pivoting of the cam 34. A pocket 72*a* (FIGS. 3, 6 and 11) having left and right side walls 72*b*, 72*c* limits lateral movement of the lower portion of the cam 34. Left and right guide flanges 76*a*, 76*b* are connected to the lever 36 and limit lateral movement of the upper portion of the cam 34.

Figure 2:
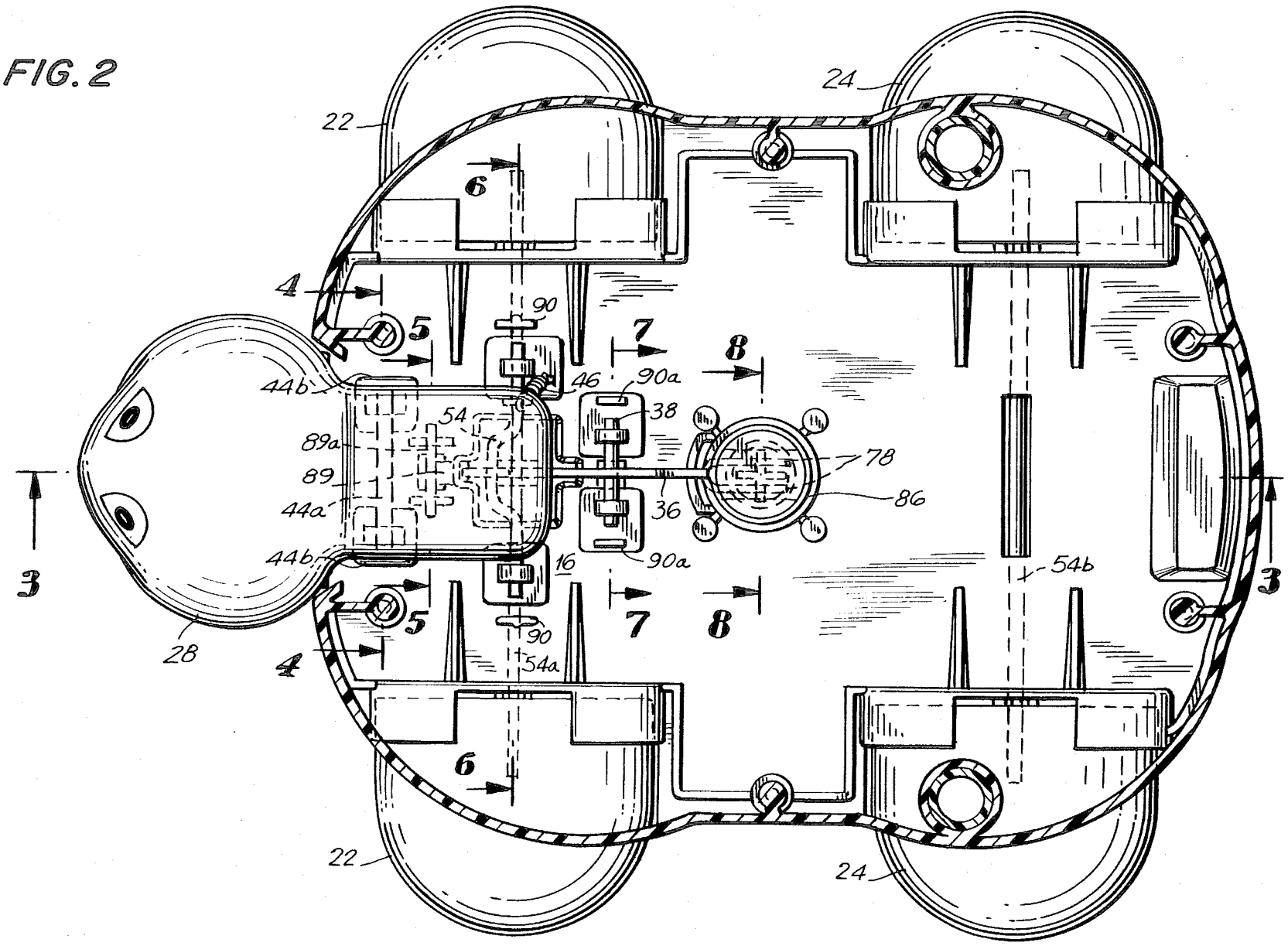
FIG. 2 is a top plan view, partly in section, taken substantially in the plane 2—2 of FIG. 1 and looking in the direction of the arrows.

The second portion 42 of the lever 36 is formed with a bifurcation 78 (see especially FIGS. 2 and 8). The two arms of the bifurcation 78 pass on either side of a substantially flat, vertically mounted plate 80 and engage studs 82 extending from the plate 80 in the transverse direction. Accordingly, pivoting of the lever 36 between the positions shown in FIGS. 3 and 11 causes reciprocation of the plate 80 in the vertical direction.

The vertical plate 80 is integral at its upper end with a horizontally mounted circular plate 84 (FIGS. 3, 8 and 11). The horizontal plate 84 thus is adapted to reciprocate in the vertical direction. When moved to its lower position as shown in FIG. 11, the balls or marbles 32 drop down under the influence of gravity and at least some of them are received within a cylindrical portion 86 of the funnel-shaped container 48. The remainder of the balls or marbles 32 accumulate in the bottom of the funnel shaped container 48 above the cylinder 86. The compression spring 50 presses at its upper end against the lower surface of the horizontal plate 84 and at its lower end against a generally circular flange or brace 88 integral with, and extending into the interior of, the cylinder 86. Accordingly, when the cam 34 releases the lever 36, the spring 50 forces the horizontal plate 84 abruptly upwards from the position of FIG. 11 to the position of FIG. 3. This also raises the vertical plate 80 and the studs 82. The studs 82 by virtue of their engagement with the second portion 42 of the lever 36 pivot the lever 36 in the counterclockwise direction to the position of FIG. 3. The movement of the spring 50 is abrupt, as indicated above, when the circular motion drive 54 moves from the section 60 of the active portion 52 of the cam 34 to the section 58 thereof, permitting the cam 34 to drop from its elevated position (FIG. 11) to its normal or lower position (e.g., FIG. 3). This abrupt movement causes a pop-ejection of the balls or marbles 32.

At the same time, since the lever 36 is now in the horizontal position, it no longer holds the head 28 in the nodding position, and the tension spring 46 pulls the head 28 from the nodding position shown in FIG. 11 to the normal position shown in FIG. 3.

Figure 12:
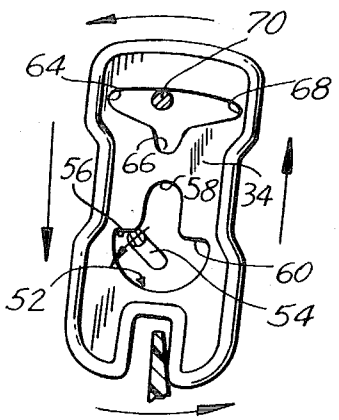
FIG. 12 is a view from the same perspective as FIG. 11 showing a cam of FIG. 11 in another operating position thereof.

The cam 34 is symmetrical about a vertical median plane normal to the plane of FIGS. 3, 11 and 12 and operates equally well in reverse. That is, if the circular motion drive 54 turns clockwise instead of counterclockwise as seen in FIGS. 3, 11 and 12, the lever 36 is biased clockwise to the position of FIG. 11 when the circular motion drive 54 is in about the 11 o'clock position: i.e., when it is engaged in the section 56, thereby elevating the cam 34. When the circular motion drive 54 reaches approximately the 12 o'clock position (not illustrated), it becomes suddenly disengaged from the section 56 and becomes engaged in the section 58 permitting the cam 34 to drop and thereby permitting the lever 36 to be returned to the normal or horizontal position of FIG. 3 by virtue of action of the compression spring 50. In its sudden expansion, the spring 50 causes a popping noise appealing to a young child and a pop-ejection of the balls or marbles 32 within the hollow interior of the body 12, just as in the case of normal or forward movement of the toy 10.

In accordance with the present invention, the first and second ancillary movements exemplified by the nodding of the head 28 and the accumulation and pop-ejection of the balls 32 can be effected by manual operation of the first branch of the ancillary movement generator. To this end, a trigger 89 is pivotally mounted on a shaft 89*a* which is affixed to the head 28. The shaft 89*a* supporting the trigger is parallel to and displaced from the shaft 44*a* about which the head 28 pivots. The trigger 89 is thus movable in an arc centered on the shaft 44*a* and is engageable with the portion 40 of the lever 36 (FIG. 3) so that, when the head 28 is rotated counterclockwise from the position of FIG. 3, even if the toy 10 is stationary the trigger 89 will pivot the lever 36 clockwise (from the perspective FIG. 3), whereby the spring 50 is loaded. Then, upon continued rotation of the head 28 to the nodding position, the arc described by the trigger 89 causes it to release (disengage from) the lever 36, whereby the spring 50 is released and abruptly effects the pop-ejection of the balls 32.

The head 28 if released then returns to the normal position of FIG. 3 under the influence of the spring 46. The trigger 89 pivots counterclockwise about its shaft 89*a* in order to clear the end 40 of the lever 36 during this return movement. Having cleared the end 40 of the lever 36, the trigger 89 rotates clockwise about the shaft 89*a* under the influence of gravity or of a spring (not shown) to the position of FIG. 3 so that it is again in position to engage the lever 36 and actuate it as described above. A flange 89*b* integral with the head 28 limits the clockwise movement of the trigger 89.

Tabs 90 limit the transverse movement of the bar or rod 70 so that it is retained in its proper operating position. Tabs 90*a* similarly limit the transverse movement of the pivot shaft 38.

A lip 92 formed on the bottom of the container 48 fits around the outside of the upper end of and the cylinder 86.

The entire toy 10, except possibly the springs 46 and 50 and axles 54*a* and 54*b*, can be made of a durable, safe and inexpensive plastic such as polyethylene.

Thus there is provided in accordance with the invention a novel, safe and durable push or pull toy that effects ancillary movements having a special appeal to toddlers and other young children. The toy remedies the problems of conventional push-pull toys noted above and, in particular, is attractive to, and safe for use by, young children and rugged enough to withstand considerable abuse without danger of falling apart.

Many modifications of the preferred embodiment of the invention disclosed above will readily occur to those skilled in the art. For example, while the spring 46 is disclosed as a tension spring tending to restore the head 28 to the normal position and the lever 36 is disclosed as pivoting the head to a nodding position, those skilled in the art could readily modify the apparatus to have the spring bias the head to a nodding position and have the lever 36 restore the head to the normal position. Similarly, while a handle 26 is illustrated as the means for application of a pushing force to the toy 10, a pull string can be provided alternatively or in addition, as noted above, whereby the toy 10 can be employed as a pull toy. Moreover, the toy can be adapted for use as a wagon, etc.

Many other modifications of the preferred embodiment of the invention disclosed herein will readily occurred to those skilled in the art; accordingly, the invention is to be construed as including all structure that falls within the scope of the appended claims.

I claim:

1. A push or pull toy comprising:

a body portion formed in the shape of an animal body and defining an internal concave surface and a transparent window overlying said internal concave surface to form a chamber;

a plurality of objects freely contained within said internal chamber;

a head portion pivotally supported by said body portion;

support and transport means, including a plurality of wheels, for supporting said body portion and enabling transport thereof over a supporting surface in response to an applied force;

dual ancillary movement means having a first branch coupled to said head portion and adapted to effect nodding movement of a first character of said head portion and a second branch adapted to effect a second ancillary movement of a popping action imparted to said objects in a sparadic projection of two or more objects simultaneously against said transparent window;

collecting means defined in said internal concave surface causing said objects to accummulate near said second ancillary movement means;

said ancillary means effecting both of said ancillary movements in response to actuation by said support and transport means.

2. A toy according to claim 1; wherein said objects include balls.

3. A toy according to claim 2; wherein said objects are of different sizes.

4. A toy according to claim 2; wherein said objects are of different colors.

5. A toy according to claim 1; wherein said second ancillary movement includes an accumulation and pop-ejection of said objects within said body portion.

6. A toy according to claim 1; wherein said ancillary movement means comprises:

cam means engageable with and actuated by said support and transport means, lever means engageable with and actuated by said cam means, and mounting means mounting said lever means for pivoting movement; and wherein said first branch includes a first portion of said lever means and said second branch includes a second portion of said lever means.

7. A toy according to 6; wherein said first branch comprises:

means mounting said head portion for pivoting movement between a normal position and a nodding position, and head biasing means for biasing said head portion to one of said normal and nodding positions;

said first portion of said lever means causing periodic movement of said head portion to the other of said normal and nodding positions in response to pivoting of said lever means by said cam means, and said cam means periodically releasing said lever means so that said biasing means then restore said head portion to said one of said normal and nodding positions.

8. A toy according to 6; wherein said second branch includes a funnel-shaped container mounted within said body portion beneath said window portion, and ejection biasing means mounted in the bottom of said container; and said second portion of said lever means causes periodic loading of said ejection biasing means in response to pivoting of said lever means by said cam means, said cam means periodically releasing said lever means so that said ejection biasing means then causes pop-ejection of said objects within said body portion.

9. A toy according to 6; wherein said cam means comprises a three-section active portion and said support and transport means comprises a circular-motion drive responsive to said applied force and engageable in one of said sections for effecting pivoting movement of said lever means and movable into another of said sections for enabling a return movement of said lever means.

10. A toy according to 9; wherein said cam means further comprises a three-section guide complemental to said active portion, further comprising restraining means cooperating with said guide and engageable with any of the three sections thereof for permitting limited translation and rotation of said cam means.

11. A toy according to claim 1 wherein said ancillary movement means is so constructed that said first and second ancillary movements can be effected by manual operation of said first branch.

12. A toy according to claim 11, further comprising:

head biasing means, lever means coupled to said head portion and said first branch, lines means for loading said head biasing means, and trigger means connected to said head and engageable with said lever means so that, when said head is moved to said nodding position, said trigger means first pivots said lever means, whereby said head biasing means is loaded, then releases said lever means, whereby said head biasing means is released and abruptly effects said second ancillary movement.

13. A toy according to claim 1; wherein said support and transport means is capable of operation in a forward direction and a reverse direction and said ancillary movement means effects both of said ancillary movements in response to operation of said support and transport means in either of said direction.

14. A toy according to claim 1; wherein at least one of said ancillary movements is accompanied by a popping noise appealing to a yound child.

* * * * *